United States Patent [19]

Patterson, Jr.

[11] Patent Number: 4,875,239

[45] Date of Patent: Oct. 24, 1989

[54] PRE-TIED NECKTIE

[76] Inventor: John A. Patterson, Jr., 204 College Ave., Fruitland Pk., Fla. 32731

[21] Appl. No.: 230,306

[22] Filed: Aug. 9, 1988

[51] Int. Cl.[4] ..... A41D 25/02; A41D 25/14

[52] U.S. Cl. ..... 2/152 R; 2/153; 2/145; 2/155

[58] Field of Search ..... 2/145, 152 R, 152 A, 2/155, 156, 153

[56] References Cited

U.S. PATENT DOCUMENTS

| | | | |
|---|---|---|---|
| 2,798,226 | 7/1957 | Kanter | 2/153 |
| 3,222,684 | 12/1965 | Kanter et al. | 2/153 |
| 3,237,208 | 3/1966 | Kanter et al. | 2/153 |
| 3,336,600 | 8/1967 | Kantee | 2/153 |
| 3,336,601 | 8/1967 | Kanter et al. | 2/153 |
| 3,426,361 | 2/1969 | Ellin | 2/153 |
| 3,820,166 | 6/1974 | Govner | 2/153 |
| 3,942,192 | 3/1976 | Harris | 2/152 R |
| 3,964,105 | 6/1976 | Gideon | 2/152 R |
| 4,337,539 | 7/1982 | Nagarian | 2/153 |
| 4,489,443 | 12/1984 | Ellin | 2/152 R X |
| 4,627,113 | 12/1986 | Lord | 2/144 |
| 4,748,692 | 6/1988 | Fukushima | 2/152 R |

*Primary Examiner*—Werner H. Schroeder
*Assistant Examiner*—Jeanette E. Chapman

[57] ABSTRACT

A support and fastening means for producing a pre-tied necktie using a modified form of body member and a support strap thereon, in which the support strap and body member reduce manufacturing costs while producing a superior product. This result is accomplished by replacing the spring clamp with the less expensive support strap which can be produced by the tie manufacturer, rather than having to be contracted out. The old spring clamp is replaced by a support strap which secures the tie around the wearer's neck and under the collar, and is detachably joined together at its ends by hook and loop area or "Velcro" fasteners secured to their respective overlapping ends. The support strap is engaged and aligned with the body member by pushing the rear post and wing posts through their respective punch holes in the support strap. A simplified necktie with only 2 pre-punched holes is more easily tied around the body member so that the ends of the support straps exit the knot at the wing tips and produce a pre-tied necktie that, when worn, looks identical to a standard necktie.

14 Claims, 1 Drawing Sheet

PRE-TIED NECKTIE

BACKGROUND OF THE INVENTION

The present invention relates to improvements in necktie knot support assemblies which serve as a mechanical foundation for receiving and fixing of a fabric necktie, to be wrapped therearound, so that the ultimate composite product serves as a pre-tied necktie, with a support strap enabling the user to simply apply the pre-tied necktie around the neck and under the collar. The invention also relates to a simplified knot tying procedure. The necktie being releasable and removable at will.

The broad idea is not new. Pre-tied neckties, to be inserted into place for wearing, have been used for many decades. Such neckties provided with a spring clamp or support strap for firmly securing the tie on the wearer, have also been patented. To my knowledge, the spring clamp pre-tied neckties have been relatively complex since they comprised, in addition to a plastic, forming body member, a metal spring clamp which not only required somewhat skilled and laborious construction, but also often resulted in an insecure and unnatural-looking necktie, even when clamped on properly, due to the fact that shirt collars vary according to the designers' personal preferences. The spring clamp also tends to grab the hair on some wearers' neck.

Examples of some spring clamp and support strap pre-tied neckties are found in U.S. Pat. Nos. 2,798,226; 3,220,015; 3,222,684; 3,237,208; 3,336,600; 3,336;601; 3,343,176; 4,337,539; and 4,627,113. All these patents disclose and describe the basic nature of such later necktie assemblies. They further reveal the disadvantages which I have now discerned and have herein not only eliminated but have produced a less expensive, less difficult and time-consuming product with superior results.

SUMMARY OF THE INVENTION

It is an object of the present invention to provide necktie knot support assembly which: Comprises a simplified basic knot-forming body member, —reduces the number of holes that must be punched in the necktie by 50%—reduces the difficulty of the knot-tying process as well, together with a support strap which: Replaces the spring clamp on the old pre-tied neckties—can be produced by the necktie manufacturer thereby giving the manufacturer much greater production control, —yields a completely natural-looking knot due to the alignment of the support strap within the knot. This design eliminates the discomfort some men experience when the spring clamp grabs the hair on their neck, and also eliminates the occasional embarassment and aggravation that is experienced when a wide collar design allows the corners of the knot to pop out of the collar revealing the pre-tied design of the necktie.

Additional objects and advantages of the invention will be apparent from the following specifications when taken in connection with the accompanying drawings in which:

FIG. 1—is a front perspective view of a completely pre-tied necktie and support strap, the lower fabric being partly broken away, the broken lines illustrating the knot-forming body member of this invention.

FIG. 2—is a front elevational view of the main body member.

FIG. 3—is a rear elevational view thereof.

FIG. 4—is a bottom plan view thereof.

FIG. 5—is a side elevational view thereof.

FIG. 6—is a rear elevational view of the complete pre-tied necktie with the lower fabric of the necktie being partly broken away, as well as the ends of the support strap.

FIG. 7—is an exploded view of the knot-forming assembly components; and

FIG. 8—is an elevational fragmentary plan view of the conventional, though simplified, form of necktie advantageously employed with the new knot-forming assembly components.

DETAILED DESCRIPTION

Figure 1:
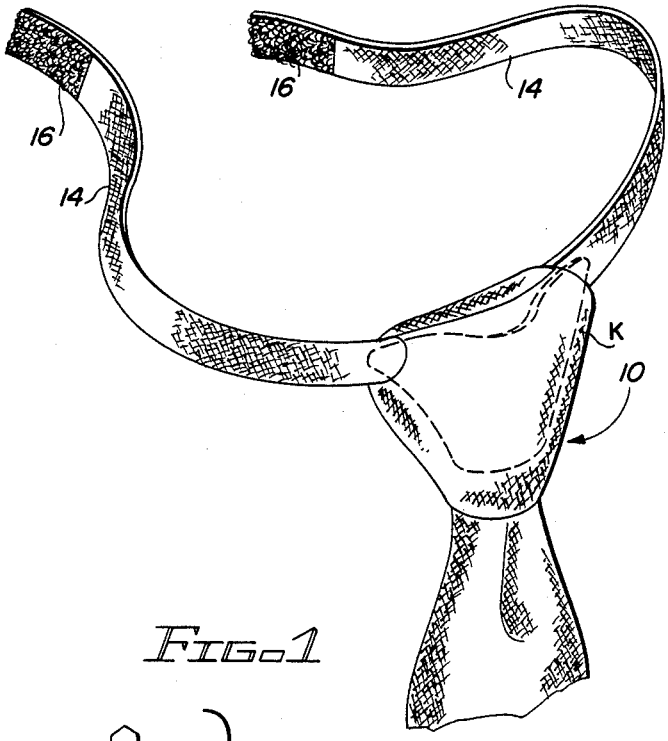
Figure 2:
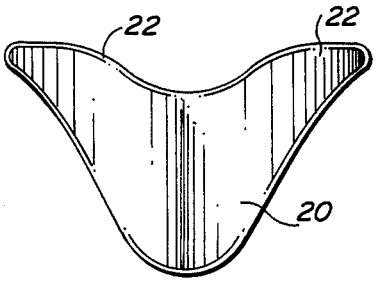

Referring in detail to the drawings, there is shown in FIG. 1, the fully assembled pre-tied necktie 10, partly broken away at its bottom end. The formed knot K is positioned in front of the neckband of a shirt collar.

The necktie 10 is held in place by wrapping the support strap 14 around the neckband of the shirt collar and then overlapping and joining the "Velcro" ends 16 of the support strap 14.

Referring to FIG. 1, the support strap is designed with a center portion made of a non-elastic, flexible material, preferably that material from which the tie was made, having secured to its respective ends the hook and loop portions or "Velcro" fasteners 16. A punched hole 17 at some convenient place in the center portion of the support strap allows the support strap to be engaged to the rear post 24 of the body member 20. And punched holes 18 engage wing posts 25 and provide for proper alignment of the support strap. Referring now to FIGS. 2–5, the body member 20 is generally shaped to determine the formation and appearance of the ultimate knot K, such body member 20 is normally fabricated by molding somewhat resilient polymer plastic material such as polyethylene or the like, or any substitute therefore whether metal or pressed fiber board, for example. It comprises conventional rearwardly directed side wings 22 connected by a central curved bridging wall 21 which flows smoothly into the said rearwardly directed side wings giving the front of the body member 20 a smooth, uninterrupted contour.

Figure 3:
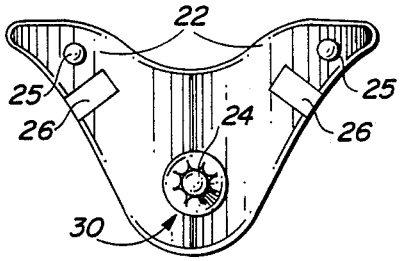
Figure 4:
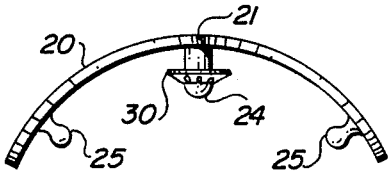
Figure 5:
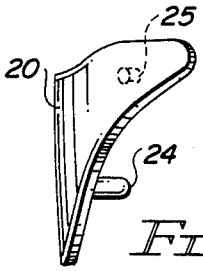

Referring to FIG. 3, it is seen that wing support strap alignment posts 25, (or alternative alignment clips 26), are integrally molded on the rear side and to either side of the rear post 24 of the body member 20.

As has been well known in the past, and has been described for example in U.S. Pat. No. 4,337,539, a rear post 24 (element 36 in that patent), projects outwardly for the purpose of urging or tilting the formed knot K in an elevated manner so as to avoid a flattened, unaesthetic appearance of the knot. I have herein increased its usefulness and purpose by attaching the support strap 14 to the rear post 24 so that the support strap cannot be pulled out of the knot inadvertently.

Figure 7:
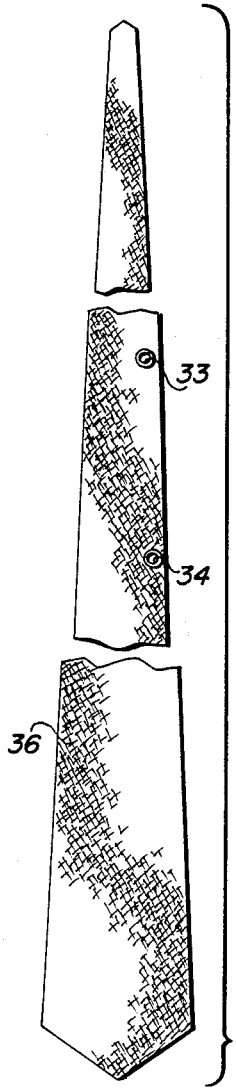

The formation of the support assembly should now be evident. Referring to FIG. 7, the assembler simply inserts the rear post 24 through the punched hole 17 of the support strap 14, and then inserts the wing posts 25 through the holes 18 of the support strap (or with alternative aligning clips 26 simply slides support strap to each side of the rear post, under the aligning clips) in order to secure and align the support strap prior to tying the necktie.

Figure 8:
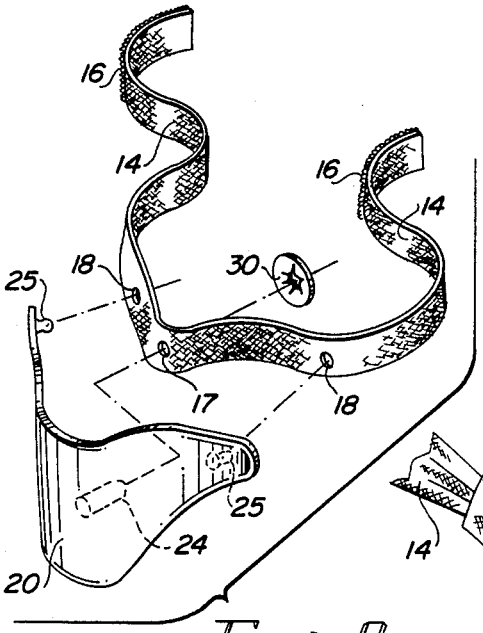

The necktie, as shown in FIG. 8, is conventional with the exception that the large holes as described in U.S.

Pat. No. 4,337,539, FIG. 9 (elements 47 and 48 in that patent) have been eliminated, thus leaving only the smaller holes, elements 33 and 34 of the present invention remaining.

It remains only to finally form and tie the necktie 36 shown in FIG. 8, to the support assembly. Necktie 36 is shorter than conventional tie-it-yourself neckties, being about 35 inches long. The final forming is conventional though simplified. Briefly, post 24 is inserted into hole 33. Then the necktie is wrapped horizontally around the wings 22, including the central bridging wall 21. Finally, after looping the necktie, the post 24 is inserted into hole 34, and pulled tight. All this is conventional though simplified because steps for inserting the clamp arm of the old spring clamp type pre-tied necktie through two large holes in the tie have been eliminated.

Figure 6:
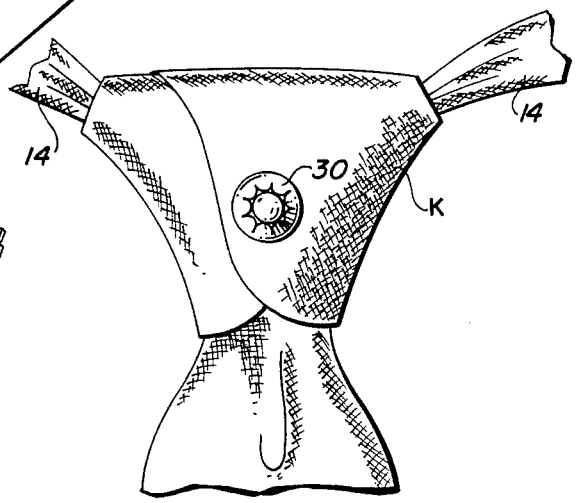

At this time, the edges of the necktie knot sections overlap at the rear, as shown in FIG. 6. In order to avoid sewing, the so-called push-on speed nut 30 which has gripping teeth, is pushed tightly down over the post 24 to complete the entire operation. This is conventional.

A preferred embodiment of my invention has been shown, but it is obvious that numerous changes and omissions may be made without departing from its spirit.

What I claim is:

1. A necktie knot support assembly for supporting a fabric pre-tied necktie for wearing about a user's neck, said assembly comprising:

a main body member having a pair of rearwardly and opposite sidewise directed wings connected by a central curved bridging wall, and shaped to determine the formation of a knot of said necktie;

a support strap having ends and a central portion;

means located on said body member for engaging said central portion of said strap to align said strap with said body member so that said ends of said strap extend respectively outwardly from said body member in alignment with said wings; and means located on said ends for releasably securing said ends to one another about said user's neck.

2. A necktie knot supporting assembly as in claim 1, wherein said central portion of said strap has a first hole therein, and wherein said strap engaging means comprises a rearwardly xtending first post located on a lower portion of said bridging wall for receiving said strap first hole thereover and forming said strap in a V-like configuration.

3. A necktie knot supporting assembly as in claim 2, wherein said strap engaging means further comprises a rearwardly extending element located on each of said wings for engaging said strap at positions intermediate said first hole and said respective ends.

4. A necktie knot support assembly as in claim 3, wherein said strap has second and third holes at said intermediate positions, and wherein said elements comprise second and third posts for receiving said second and third holes thereover.

5. A necktie knot support assembly as in claim 4, wherein said strap securing means comprises hook and loop Velcro TM -type fastening means.

6. A necktie knot support assembly as in claim 4, wherein said body member and said posts are integrally molded as a single polymer plastic material piece.

7. A necktie knot support assembly as in claim 4, wherein said posts are dimensioned, configured and oriented to secure and align said strap prior to tying said necktie and to secure said strap within the knot after tying has been completed.

8. A necktie knot support assembly as in claim 2, wherein said strap engaging means further comprises means to form said central portion into a V-shaped configuration, whereby when said necktie is tied over said body member and strap, the resulting knot will have the natural appearance of a nonpre-tied necktie.

9. A necktie knot support assembly as in claim 8, wherein said strap securing means comprises hook and loop Velcro TM -type fastening means.

10. In a necktie knot support assembly for supporting a pre-tied necktie, said assembly having a main body member having a pair of rearwardly and opposite sidewise directed wings connected by a central curved bridging wall, and shaped to determine the formation of a knot of said necktie, the improvement comprising:

a support strap having ends and a central portion;

means located on said body member for engaging said central portion of said strap to align said strap with said body member so that said ends of said strap extend respectively outwardly from said body member in alignment with said wings; and means located on said ends for releasably securing said ends to one another about a user's neck.

11. A fabric pre-tied necktie for wearing about a user's neck, said necktie comprising:

a main body member having a pair of rearwardly and opposite sidewise directed wings connected by a central curved bridging wall, and shaped to determine the formation of a knot of said necktie;

a support strap having ends, and a central portion with a first hole therethrough;

means located on said body member, including a rearwardly extending first post receiving said first hole of said central portion, engaging said strap and aligning said strap in V-like configuration with said body member so that said ends of said strap extend respectively diagonally outwardly from said body member in alignment with said wings; and means located on said ends for releasably securing said ends to one another about said user's neck;

a length of fabric materialtied in a knot over said body member and strap central portion, said fabric material having an aperture placed over said first post; and means retaining said strap and knotted length of fabric material on said first post;

whereby said necktie has the natural appearance of a tied nonpre-tied necktie.

12. A fabric pre-tied necktie as in claim 11, wherein said strap engaging means further comprises a rearwardly extending element located on each of said wings engaging said strap at positions intermediate said first hole and said respective ends.

13. A fabric pre-tied necktie as in claim 12, wherein said strap has secod and third holes at said intermediate positions, and wherein said elements comprise second and third posts receiving said second and third holes thereover.

14. A necktie knot support assembly as in claim 13, wherein said strap securing means comprises hook and loop Velcro TM -type fastening means.

* * * * *